United States Patent [19]

Basnett

[11] Patent Number: 4,672,156

[45] Date of Patent: Jun. 9, 1987

[54] VACUUM INTERRUPTER WITH BELLOWS SHIELD

[75] Inventor: Robert T. Basnett, Hendersonville, N.C.

[73] Assignee: Westinghouse Electric Corp., Pittsburgh, Pa.

[21] Appl. No.: 848,370

[22] Filed: Apr. 4, 1986

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,594,525 | 7/1971 | Miller et al. | 200/145 |
| 4,365,127 | 12/1982 | Sakuma et al. | 200/144 B |
| 4,440,995 | 4/1984 | Lange et al. | 200/144 B |
| 4,446,346 | 5/1984 | Kashimoto et al. | 200/144 B |
| 4,614,850 | 9/1986 | Kuhl et al. | 200/144 B |

FOREIGN PATENT DOCUMENTS

| | | | |
|---|---|---|---|
| 3026244 | 2/1982 | Fed. Rep. of Germany | 200/144 B |
| 211901 | 7/1984 | Fed. Rep. of Germany | 200/144 B |
| 3343918 | 6/1985 | Fed. Rep. of Germany | 200/144 B |

*Primary Examiner*—Robert S. Macon

*Attorney, Agent, or Firm*—M. J. Moran

[57] ABSTRACT

A relatively small vacuum bottle is taught in which the fixed electrically conductive end of the fixed contact member has cup-like cylindrical walls for forming part of an arc chamber. A ceramic main body for the vacuum interrupter is axially aligned with the cup-like walls and extends therefrom to form an elongated portion of the interrupter. An external metallic bellows is attached to the other axial end of the ceramic member and extends the interrupter further. The other end of the bellows member is attached to a movable contact end piece. All of the attachments are vacuum tight. As the movable end member is moved into a disposition of electrical contact with the fixed end member the external bellows compresses at its pleats. On the other hand when the movable contact member is moved away from the stationary contact member the movable bellows expands at its pleats. The bellows is protected internally from arc heat, light and by-products by an annular constriction in the ceramic member. Alternately, the bellows and ceramic members are axially interchanged with one another so that the ceramic member moves with the movable contact member. In this case, the bellows is protected from the arc heat, light and by-products by an internal ceramic member which moves with the movable contact to seal off the region of the arc interruption from the internal portion of the bellows.

10 Claims, 4 Drawing Figures

VACUUM INTERRUPTER WITH BELLOWS SHIELD

BACKGROUND OF THE INVENTION

The subject matter of this invention relates generally to vacuum circuit interrupters and relates more particularly to relatively small vacuum bottles for vacuum circuit interrupters.

Vacuum circuit interrupters and vacuum bottles are known. Examples of vacuum bottle arrangements can be found in U.S. Pat. No. 4,440,995 entitled "Vacuum Circuit Interrupter With On-Line Vacuum Monitoring Apparatus" issued Apr. 3, 1984 to Lange et al. and U.S. Pat. No. 3,594,525 entitled "Common Parallel Operating Means for Series-Connected, Laterally Offset Vacuum Switches" issued July 20, 1971 to R. H. Miller et al. Examples of vacuum interrupters can also be found in a brochure entitled "Westinghouse Vacuum Interrupters" B-671. Typically, vacuum circuit interrupters interrupt an electrical arc within a vacuum. Once the circuit is interrupted the distance between the open contacts necessary to withstand the voltage of the circuit thereacross can be relatively small for when compared with circuit interrupters which operate in air or an insulating gas. This means that the travel distance for closing the contacts is relatively small, which helps to reduce the size of the vacuum bottle.

Typically, a vacuum interrupter comprises a cylindrical high alumina ceramic or similar insulating case having metal end caps or headers which are made of some combination of nickel, iron and/or cobalt. A fixed metal electrode protrudes into the ceramic cylinder and is electrically and mechanically interconnected with one of the end caps. A movable metal electrode protrudes through the other end cap. Contact faces on the ends of the electrodes abut during the circuit making operation for electrical continuity. A relatively flexible, cylindrical, pleated, stainless steel bellows is interposed between and brazed to a portion of the metal movable electrode and its metal end cap so that the entire region inside of the vacuum interrupter may be evacuated. The bellows alternately expands and contracts with the closing and opening respectively of the electrodes to maintain the vacuum integrity of the vacuum chamber it serves to enclose during movement of the movable electrode. The bellows is usually made of relatively thin stainless steel sheet metal (approximately 4 mils). Stainless steel is relatively non-corrosive and has a relatively long life. In addition, the bellows usually occupies space inside the ceramic cylinder. In one case shown in U.S. Pat. No. 4,365,127, entitled "Vacuum Power Interrupter" by Sakuma et al., issued Dec. 21, 1982, an external bellows is shown. Because of the flexibility required, the material which makes up the bellows is relatively thin. But, because the bellows is within the evacuated chamber and close to the contact faces, it is a likely candidate for being exposed to the light, heat and arc by-products of a contact opening operation when an arc is formed and interrupted. This light, heat and by-product of the arc all may cause the bellows to deteriorate, become non-functional or break, thus destroying the vacuum integrity of the switch or interrupter. In the past in order to solve this problem, a fixed metal shield was placed around the bellows between it and the arc region to safeguard it from the aforementioned non-desirable occurrence. An example of a shield can be found in U.S. Pat. No. 4,446,346 entitled "Vacuum Interrupter" issued May 1, 1984 to kashimoto et al. However, both the shield and the bellows take up space within the perimeter of the vacuum chamber and both are electrically conductive. Generally when one is dealing with relatively large vacuum interrupters this is rather insignificant because the volume within the chamber is sufficient to additionally accommodate the shield and bellows. However, it would be desirable to use circuit interrupting or switching devices of a relatively small size when the devices they cooperate with are relatively small. Relatively small motor contactors and similar devices do not utilize vacuum interrupters because no corresponding matching small vacuum interrupter bottles (approximately 1 inch in diameter) are available. The reason that small interrupter bottles are not available lies in the fact that small vacuum bottles have relatively little space within the vacuum chamber for the bellows and the shield. It would be desirous therefore to provide relatively small vacuum interrupter bottles which had either no bellows or no shields in the vacuum chamber.

SUMMARY OF THE INVENTION

In accordance with the invention a relatively small or miniature vacuum circuit interrupter bottle is taught in which the bellows forms an external part of the vacuum interrupter bottle rather than an internal part thereof and thus does not take up space in the vacuum chamber. In accordance with the invention the bellows is directly interconnected at one end thereof with a movable contact shaft and directly interconnected at the other end thereof with the cylindrical ceramic insulator. The other end of the ceramic insulator is interconnected with a metallic shell which has as an internal portion thereof the fixed contact of the vacuum interrupter. The internal portions of the ceramic shell is shaped to act as a shielding member for the internal portion of the bellows.

BRIEF DESCRIPTION OF THE DRAWINGS

For a better understanding of the invention, reference may be had to the preferred embodiment thereof shown in the drawings, in which.

DESCRIPTION OF THE PREFERRED EMBODIMENT

Figure 3:
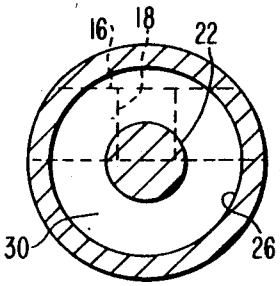
FIG. 3 shows a cross-sectional view of the vacuum bottle of FIGS. 1 and 2 through section III—III of FIG. 2.
Figure 2:
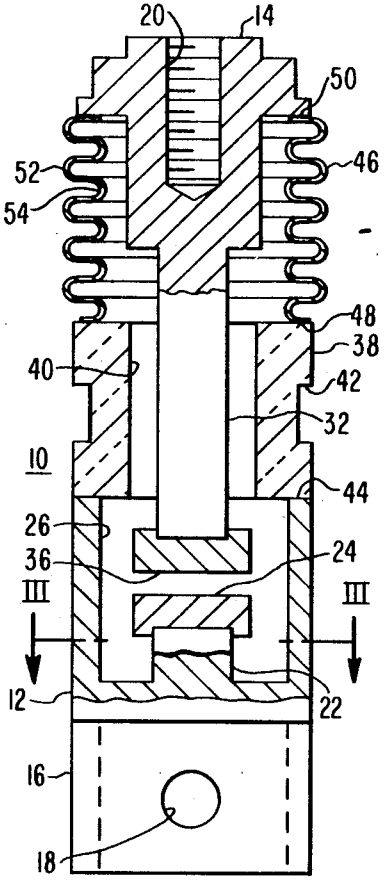
FIG. 2 shows a view of the vacuum bottle similar to FIG. 1 but rotated 90° about its longitudinal axis.
Figure 1:
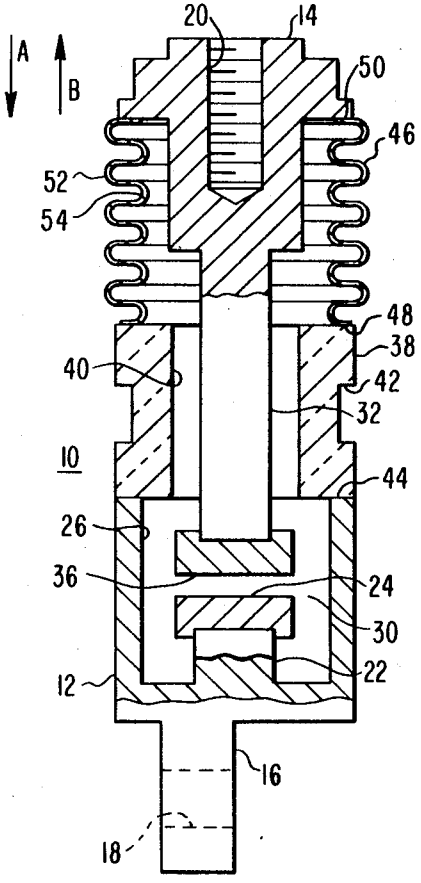
FIG. 1 shows a side elevation partially broken away of a vacuum bottle embodying the invention.

Referring now to FIGS. 1, 2 and 3, a miniaturized vacuum bottle 10 is shown. Miniaturized vacuum bottle 10, which hereinafter will be called a vacuum bottle for simplicity, is of the type which may be utilized in relatively small application devices such as switches, circuit interrupters, motor contactors and the like. In particular, vacuum bottle 10 has a stationary contact end portion or header 12 and a movable contact end portion or header 14. Stationary end portion 12 is electrically conductive and includes a terminal 6 into which a bolt hole 18 is disposed for electrically and mechanically securing a conductor or similar conductive member (not shown)

for a circuit interrupter, switch, contactor or the like thereto. Movable end piece 14 is also electrically conductive and has a threaded bolt hole 20 disposed therein for interconnecting a flexible conductive braid or other conductive member (also not shown) thereto. End piece 12 may have a circular, cylindrical protrusion 22 projecting away therefrom upon which is mounted a stationary contact face 24. End piece 12 may also include a hollow, cylindrical cup or shell member 26 which is spaced from and surrounds the protrusion 22 and the face member 24 to form the arc interrupting portion of a vacuum chamber 30. Movable end portion 14 is also electrically conductive and may include an elongated cylindrical protrusion or shaft 32 upon which is disposed a contact face 36 which is complementary with contact face 24. There is also provided a cylindrical ceramic or similar insulating main body member 38 which has a reduced cylindrical internal axial central portion 40 and a stepped external axial portion 42. The stepped external portion of the insulator 38 provides an increased creepage path on the external surface of the insulator 38 to reduce external electrical voltage breakdown between the contact end piece 12 and the contact end piece 14. Ceramic member 38 is axially aligned with the cup or shell portion 26 of the end piece 12 and securely joined thereto at 44 such as by brazing to form an elongated portion of the main body of the vacuum bottle 10. There is also provided a flexible, metallic, hollow, cylindrical bellows 46 which is brazed to the ceramic member 38 at 48 and which is brazed to a lip on the movable end piece 14 at 50 on the other end. The bellows 46 may comprise peaks 52 and valleys 54 which form pleats or convolutions which expand and contract as the attached end piece 14 is moved toward the stationary member 12 and vise versa, respectively. The entire volume defined by the perimeter made up of the movable end piece 14, the vacuum tight seal 50 between the end piece 14 and bellows 46, the bellows 46, the vacuum-tight seal between the bellows 46 and the ceramic member 38, the ceramic member 38, the vacuum-tight seal between the ceramic member 38 and the fixed end piece 12 at 44 and the fixed end piece 12 defines the evacuated portion of the vacuum bottle 10. When the end member 14 is moved in the axial direction A by a suitable operating mechanism (not shown) in a circuit interrupter switch, contactor, or the like as the case may be, the bellows 46 compresses and the contact face 36 abuts the contact face 24 thus closing a circuit between a conductor connected to terminal 16 and a conductor connected to end piece 14. When the movable end piece 14 is moved in the direction B by the operating mechanism, the contact face 36 moves away from the contact face 34 thus interrupting an electrical circuit. When this happens an arc is usually formed within the evacuated arc chamber 30. The heat, light and arc by-products of the arc are prevented from substantially impinging upon the internal portion of the bellows 46 by the shaft 32 and the enlarged mass of ceramic material around the internal constriction 40 in the ceramic member 38. This eliminates the need for a separate protective internal shield for the bellows 46.

Figure 4:
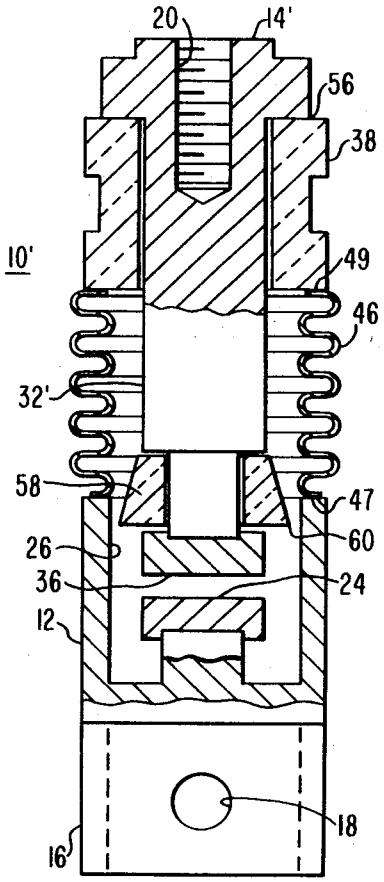
FIG. 4 shows a side elevation similar to that of FIG. 2 but for a different embodiment of the invention.

Referring now to FIG. 4, another embodiment of the invention utilizing a vacuum bottle 10' is shown. In this embodiment the stationary end piece 12 is the same as end piece 12 of FIGS. 1 through 3. Likewise, the bellows 46 is the same. However, in this case the bellows 46 is directly brazed to the end cap 12 at 47 and is directly brazed to the ceramic member 38 at 49. The ceramic member 38 is rigidly and securely attached to the movable contact member 14' in a vacuum-tight manner at 56 so that the ceramic member 38 moves with the movable end piece 14' during the opening and closing operation of the vacuum bottle 10'. A ceramic or other electrically insulating shield member 58 is provided on an elongated shaft member 32' of the movable end piece 14' to cooperate with the cylindrical walls 26 of the fixed contact end 12 to reduce the opening 60 therebetween the contact break operation so that the internal portion of the bellows 46 is protected from the light, heat and arc products of the arc drawn during the circuit break operation for the circuit interrupter or bottle 10'.

Referring once again to FIG. 1, for example, the vacuum tight interface between the stainless steel bellows 46 and the movable end piece 14 is formed by brazing in a conventional prior art manner. Since the material of end piece 14 comprises some combination of the elements nickel, iron and/or cobalt for example, the coefficient of thermal expansion thereof relative to that of the stainless steel bellows 46 is comparable. Consequently, after the brazing process takes place, wherein a silicon copper eutectic brazing material is raised to a temperature above 780° C. which is its melting point, the subsequent reduction in diameter of the bellows 46 and end piece 14 as the two pieces cool to room temperature, is generally equal so that no mechanical stress is placed on one member by the other as the result of uneven diameter change. This concept applies even if the bellows 46 was relatively rigid and thick walled.

It is to be understood that the configuration of the movable end piece 14 and 14' is non-limiting.

The apparatus taught with respect to the embodiments of this invention have many advantages. One advantage lies in the fact that the bellows does not need a separate metallic shield nor does it have to be internally mounted, thus providing an opportunity to produce a relatively small vacuum circuit bottle.

What I claim as my invention is:

1. A circuit interrupter vacuum bottle, comprising:

first electrically conductive contact end means;

second electrically conductive contact end means movable in relationship to said first electrically conductive contact end means and having an elongated shaft portion;

hollow electrically insulating enclosure and spacing means secured to said first electrically conductive contact end means in vacuum-tight relationship for forming a portion of a vacuum chamber in which an electrical arc is formed during circuit interruption, said hollow electrically insulating enclosure and spacing means having a central internal restriction through which said shaft portion protrudes; and generally hollow flexible bellows means affixed axially in vacuum-tight relationship between said electrically insulating enclosure and spacing means on one end and said second electrically conductive contact end means on the other end for forming the completing portion of said vacuum chamber and for flexing when said second electrically conductive contact end means is moved away from said first electrically conductive contact end means so that the vacuum integrity is retained in said chamber, said electric arc being formed in a region which is spaced from said bellows means by said restriction so that arc products are shielded from the internal portion of said bellows means by said hollow electrically insulating enclosure and spacing means.

2. The combination as claimed in claim 1 wherein said electrically insulating enclosure and spacing means comprises a ceramic material.

3. The combination as claimed in claim 2 wherein said ceramic material comprises alumina.

4. The combination as claimed in claim 1 wherein said bellows means comprises metal.

5. The combination as claimed in claim 4 wherein said metal comprises stainless steel.

6. A circuit interrupter vacuum bottle, comprising:

first electrically conductive contact end means with a hollow arc chamber portion partially surrounding a first contact face;

second electrically conductive contact end means movable in relationship to said first electrically conductive contact end means, said second electrically conductive contact end means having an elongated portion protruding therefrom upon which a second contact face is disposed;

a hollow electrically insulating spacer means fixedly disposed on said second electrically conductive contact end means at one end thereof in vacuum-tight relationship so that said elongated portion protrudes therethrough; and generally hollow flexible bellows means affixed axially in vacuum-tight relationship between the other end of said insulating spacer means and said first electrically conductive contact end means, said elongated portion having a radial ceramic shield disposed thereon between said second contact face and said bellows so that when said second and first contact faces separate arc products produced thereby are prevented from impinging upon said bellows.

7. The combination as claimed in claim 6 wherein said hollow electrically insulating spacer means comprises a ceramic material.

8. The combination as claimed in claim 7 wherein said ceramic material comprises alumina.

9. The combination as claimed in claim 6 wherein said bellows means comprises metal.

10. The combination as claimed in claim 9 wherein said metal comprises stainless steel.

* * * * *